United States Patent [19]

Foote

[11] 4,128,956

[45] Dec. 12, 1978

[54] SINGLE SHOT RIFLE HAVING FALLING BREECHBLOCK INTEGRAL WITH STOCK

[76] Inventor: John P. Foote, 315 Piedmont Rd., Marietta, Ga. 30006

[21] Appl. No.: 818,460

[22] Filed: Jul. 22, 1977

[51] Int. Cl.[2] ..... F41C 11/04

[52] U.S. Cl. ..... 42/23; 42/75 C

[58] Field of Search ..... 42/23, 24, 71 R, 75 C, 42/75 A

[56] References Cited

U.S. PATENT DOCUMENTS

| | | | |
|---|---|---|---|
| 206,217 | 7/1878 | Borchardt | 42/23 |
| 1,448,297 | 3/1923 | Hedrick | 42/23 |
| 2,289,098 | 7/1942 | Buhmiller | 42/23 |

*Primary Examiner*—Charles T. Jordan
*Attorney, Agent, or Firm*—Patrick F. Henry

[57] ABSTRACT

A single shot rifle comprises the usual elongated barrel of any desired calibre with the shell receiving end screwed into a receiver having spaced sides defining a passage for a cartridge to be inserted and removed therefrom. A falling breechblock is provided with a stock extension for insertion in and permanent mounting on a stock so that the breechblock and stock move together. The trigger mechanism, hammer and extractor mechanisms may be of any suitable and conventional construction including the usual cocking lever which actuates the spring biased hammer that is released by a trigger.

13 Claims, 4 Drawing Figures

SINGLE SHOT RIFLE HAVING FALLING BREECHBLOCK INTEGRAL WITH STOCK

BACKGROUND OF THE INVENTION

Single shot rifles having falling breechblocks are quite common in the art and go back quite a long period of time. The so-called falling breechblock generally comprises a breechblock assembly which is mounted for somewhat vertical movement between the barrel receiver and the stock usually in a sort of cavity or space which is defined between the receiver and the stock and sometimes covered with metal plates. This arrangement requires the construction and assembly between the ends of the stock and the end of the barrel or receiver with sufficient structural characteristics to provide the cavity for the falling breechblock and the extractor, trigger and hammer mechanism if indeed the rifle has an extractor mechanism and exposed hammer. There is the possibility of the structural weakness at this point unless properly reinforced and designed and also the cost of producing a single shot rifle with the usual falling breechblock. The present arrangement avoids any of the disabilities or drawbacks of the falling breechblock single shot rifle by an arrangement wherein the breechblock is not actually a falling breechblock in the sense of the aforementioned devices but rather is the forward portion or one end of the stock whereby the entire breechblock and stock move for a limited upward or downward distance to allow the extraction of the shell and insertion of a new cartridge or for mechanical operation of an extractor if there is one. It is also an interesting and attractive firearm for a sportsman who likes a single shot rifle.

SUMMARY OF THE INVENTION

The arrangement in a single shot rifle with or without a built-in extractor and/or exposed hammer wherein the block or similar member which closes the end of the barrel during firing is supported on and attached to the stock of the rifle whereby a control lever operates the breech and stock upwardly and downwardly.

Another advantage resides in the ease of barrel removal so that other barrels of different cartridge size may be installed. This is possible because the extractor stays with the barrel assembly.

A primary object of this invention is to provide a single shot rifle wherein the breech and the stock are mounted together and attached for simultaneous movement.

Another object of this invention resides in the provision of an actuating lever which is connected to the barrel and also to the breech which is attached to the stock so that the actuating lever causes upwardly or downwardly movement thereof to provide access to the chamber for insertion of the cartridge, closing of the breech and opening of the breech for removal of the cartridge.

Another object of this invention resides in the simplicity of the construction both from the standpoint of manufacture and assembly as well as subsequent disassembly for repair, cleaning or otherwise and resulting from the arrangement of the barrel and assembly with the breechblock.

Other and further objects and advantages of this invention will become apparent upon reading the following description taken in conjunction with the accompanying drawings.

DESCRIPTION OF A PREFERRED EMBODIMENT

Figure 1:
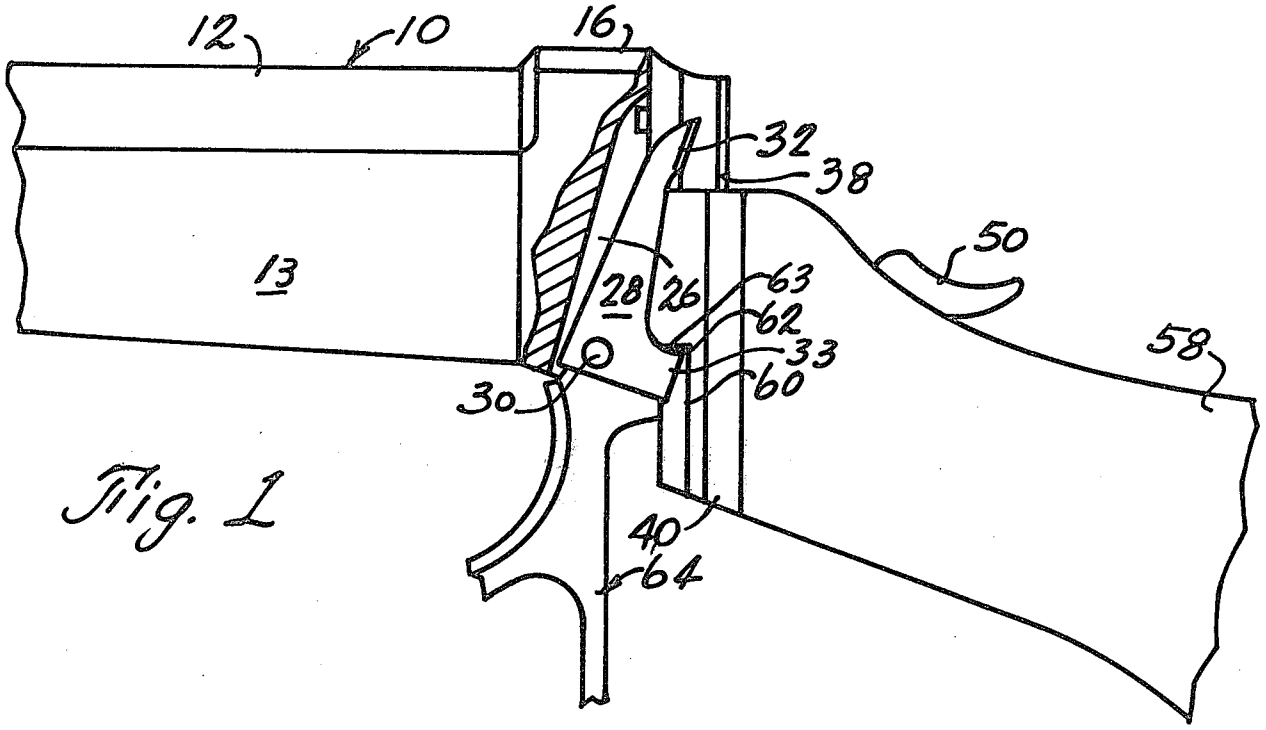
FIG. 1 is a side elevation view of the breech portion of the rifle with parts thereof broken away.
Figure 4:
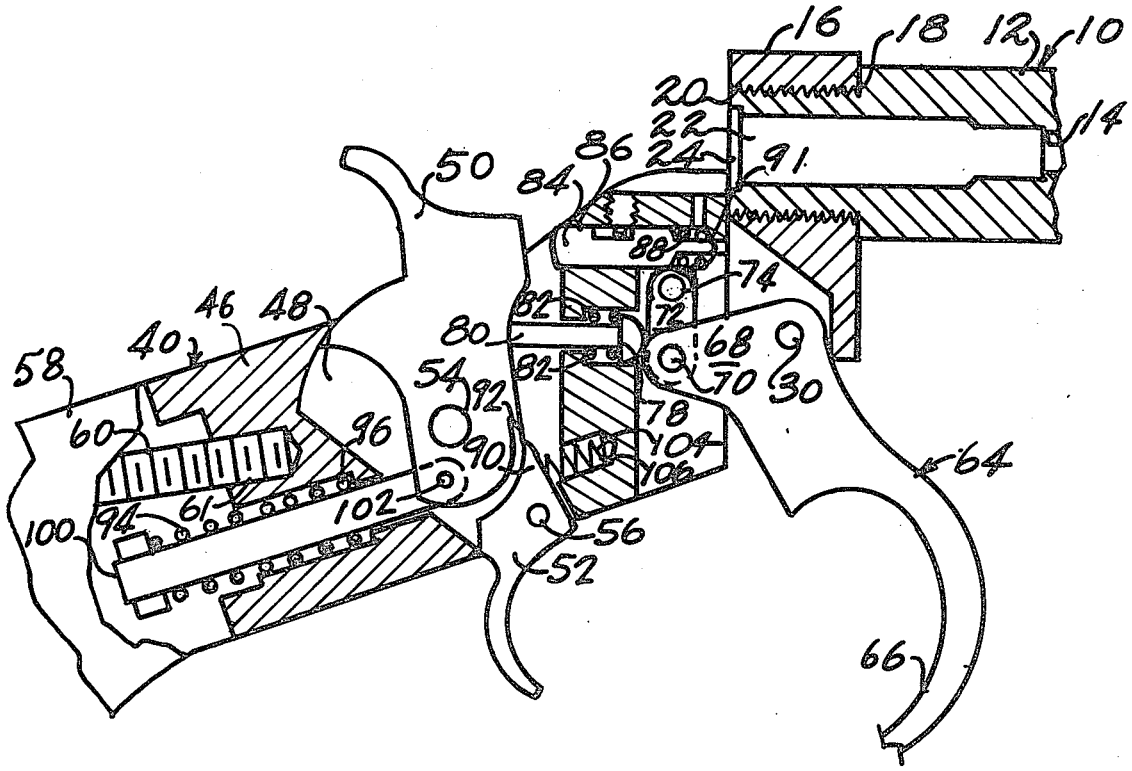
FIG. 4 is a cross-sectional view the same as that shown in FIG. 3 except that the breechblock and stock has been lowered to open the breech.

The rifle 10 shown in FIG. 1 comprises a barrel 12, which may have a removable forepiece 13 of wood or other material, and which is constructed and made by any suitable process with a bore 14 of any desired calibre. A receiver 16 receives the threaded end 18 (see FIG. 4) of the barrel 12 into a threaded opening 20 in the receiver 16 which is conventional construction for a single shot rifle. Thus the barrel 12 and receiver 16 are an assembly known as a barrel assembly. The barrel 12 is made by conventional methods and has been chambered in size and shape to accommodate a cartridge 22 which may have a rim 24 thereon. Barrel 12 is easily removed and replaced by another one of different cartridge size. The bottom portion of the receiver 16 is shaped to provide an extractor cavity for an extractor 28 which is pivoted to the receiver 16 on a pivot pin 30. The upper end 32 of the extractor 28 is shaped in conventional fashion to engage the rim 24 of the cartridge 22 and extract same from the chamber and the lower end has a projecting tip 33. The extractor 28 remains with the receiver 16 which makes it easier to remove and replace the barrel 12.

Figure 2:
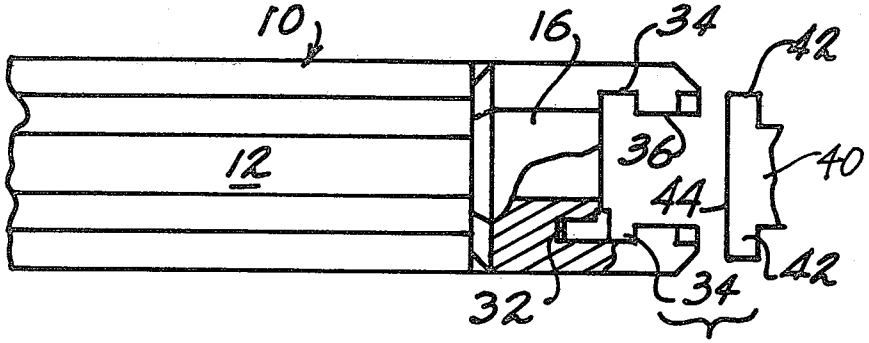
FIG. 2 is a top plan view of the breech assembly shown in FIG. 1.

The receiver 16 is shaped as seen in FIG. 2 to provide opposing grooves 34 defined by sides 36 of the receiver providing vertical guides having respective faces 38.

The breechblock 40, which is connected to the receiver 16 through pin 30 by a means to be described, comprises vertical sides 42 which are somewhat complementary to and fit into the grooves 34 in the receiver 16 between the sides 36 so as to slide upwardly and downwardly in the grooves 34 without becoming detached from the receiver 16 thereby bringing the face 44 of the breechblock 40 into position to open or close the chamber to insert or extract the cartridge 22.

The breechblock 40 includes an elongated flat plate portion 46 in which there is formed a large cavity 48 in which there is mounted a hammer 50 and trigger 52 which are attached by respective pivots 54, 56.

Breechblock 40 is attached to a stock 58 by a long screw 60 screwed into threaded hole 61 whereby the breechblock 40 is a rigid assembly with the stock 58 and the stock 58 and breechblock 40 are rigidly attached together and connected to each other whereby both must move together or not at all unless disassembled.

There is a notch 62 in the face of breechblock 40 having an edge 63 which trips the extractor 28 upon downward movement of the breechblock 40 and the notch 62 operates on the tip 33 of extractor 28.

Figure 3:
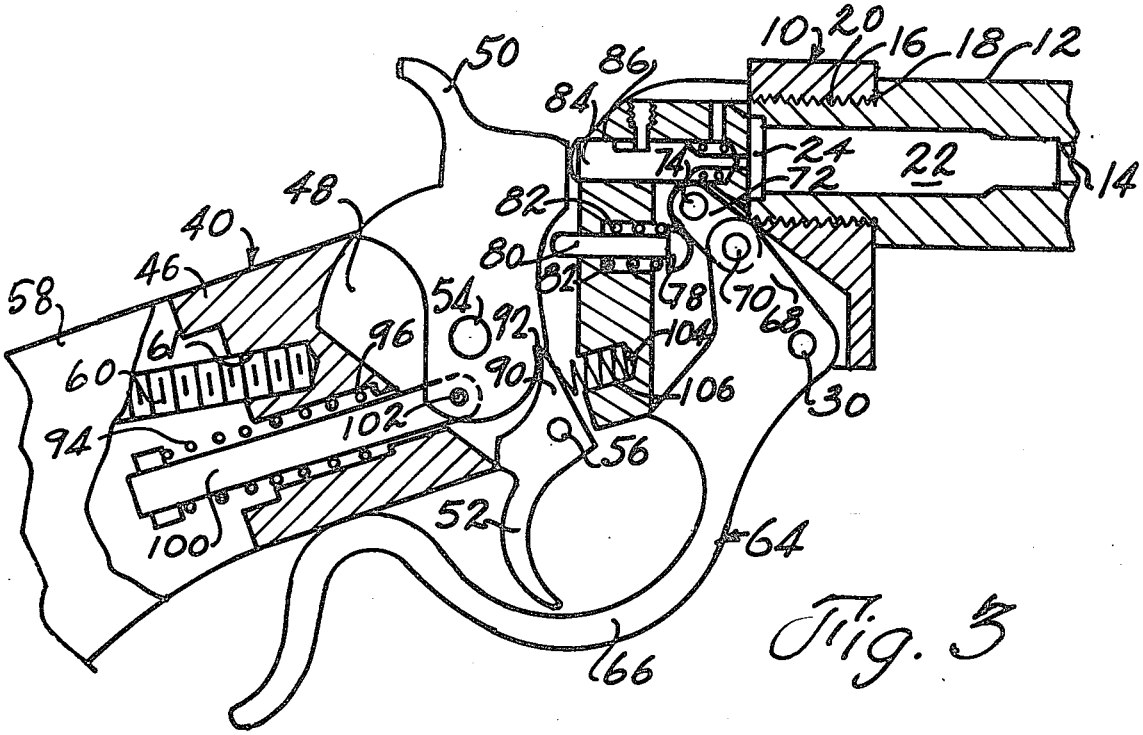
FIG. 3 is a cross-sectional view taken substantially vertically and medially thru the breech portion of the rifle shown in FIG. 1.

An action lever 64 of conventional curvature and shape to provide a cover 66 around trigger 52 is mounted within the cavity 26 on pivot pin 30 and has a projecting portion 68 attached by pin 70 to a link 72 ich is attached by pin 74 to the breechblock 40 and seen in FIG. 3) with the action lever 64 closed ıund the trigger 52 the link 72 extends with the three s 30, 70 and 74 almost in a straight line but as seen in G. 4 upon the rotation and movement of the action er 64 about its pin 30 the entire breechblock 40 is ısed to move downwardly which motion pulls the echblock 40 downwardly sufficiently to expose the tridge 22, or the empty chamber as the case may be, allow extraction of any spent cartridge 22 or the ertion of a fresh cartridge. The rotation of the link 72 ıgainst the curved head 78 of detent 80 which is like in. Head 78 of detent 80 moves against a spring 82 ıfined in a space within the breechblock 40 to engage face of the hammer 50 forcing hammer 50 to rotate ond the half-cock or safe position which brings the nmer 50 out of position against a firing pin 84 which erates against a confined spring 88 therein thru a all opening 91 to strike the cartridge upon release of hammer 50 which takes place when the tip 90 on ger 52 disengages from the small hammer notch 92 he hammer.

A hammer coil spring 94 is mounted within a space 96 breechblock 40 and has a spring compressor 100 unted therein which is connected to the bottom of hammer 50 by pin 102 so that cocking of the hamr 50 compresses spring 94 which is released suddenly on disengagement of the trigger 52 in order to fire the e.

There is provided a small coil spring 104 in a cavity in breechblock 40 and bearing against the face of trigger 52 for smoother and more controlled operaı thereof and to force the trigger 52 into the hammer ch 92.

The details and description of the extractor 32, the ion lever 64, the hammer 50 and the trigger 52 is for pose of disclosure of an operable device and is not only arrangement which may be used. It is possible use any conventional action in this rifle and to, ong other things, eliminate the hammer altogether ile providing some means to translate movement m the trigger 52 to the firing pin 84 and also to elimie the extractor if one is willing to extract catridges fingernail, fingertip, or small implement. It is impor- t to note, however, that an action and arrangement been provided which rigidly connects the breechck 40 to the stock 58 and in operation both the comed breechblock 40 and stock 58 move from an uprdly position closing the chamber in which is unted cartridge 22 to an open position of the action ich exposes the cartridge 22 or the chamber to reve the first cartridge.

The receiver 16 and barrel 12 are easily removed m the breechblock 40 by removing pin 30 and the rel 12 is easily removed from the receiver 16 for lacement by another barrel of different cartridge e. The extractor 28 remains on and stays with the rel 12 and receiver 16 assembly.

While I have shown and described a particular emliment of this single shot rifle this is by way of illustion and as mentioned above is not limited for exam- to a particular type of action or extractor and conıplates the use of any well known substitutable mechsm and there are various other alterations, changes, viations, eliminations, additions, substitutions and partures which may be made in the preferred embodint without departing from the scope of this invention as defined only by a proper interpretation of the appended claims.

What is claimed is:

1. In a single shot rifle:

a barrel having a cartridge chamber therein, a breechblock assembled on said barrel for substantial upwardly and downwardly movement thereon to open and close said cartridge chamber for the purpose of inserting or removing a cartridge, a stock connected to and movable with said breechblock on said barrel, and means on said rifle for moving said breechblock upwardly and downwardly from an upward position to a downward position and vice versa.

2. The device in claim 1 including a cartridge extractor mounted on said barrel.

3. The single shot rifle claimed in claim 1 wherein said means for moving comprises an action lever pivotally mounted on said rifle and being connected to said breechblock.

4. The device claimed in claim 3 wherein said action lever is pivotally connected to a link and said link is pivotally connected to said breechblock.

5. The rifle claimed in claim 2 wherein said breechblock has a frontal cavity therein and said means for moving said breechblock is attached in said frontal cavity.

6. The device claimed in claim 5 wherein there is a second cavity in said breechblock having a hammer movably mounted therein, means operable by the movement of said action lever to move said hammer from a forward firing position to a rearward cocked position, spring means for said hammer, a firing pin mounted on said breechblock and being engaged by said hammer to move forwardly through an opening in said breechblock to fire said cartridge.

7. The device in claim 6 wherein there is a receiver mounted on one end of said barrel having an opening therein for said cartridge.

8. The device in claim 7 wherein said extractor is a pivoted member.

9. In a single shot rifle:

a barrel having a cartridge chamber therein, a receiver mounted on one end of said barrel adjacent the location of said cartridge, a breechblock mounted on said receiver for substantial upwardly and downwardly movement thereon to open and close said breech thereby respectively opening and closing said cartridge chamber for the purpose of inserting or removing a cartridge, a cartridge extractor pivotally mounted on said receiver and being actuated by movement of said breechblock, a stock connected to and movable with said breechblock on said receiver, whereby said breechblock and stock are an integral assembly, means movable on said rifle for moving said breechblock from an upwardly position to a downwardly position and vice versa, comprising a manually actuated lever pivotally mounted on said receiver and being connected to said breechblock.

10. The device in claim 9: said lever being pivotally connected to a link and said link being pivotally connected to said breechblock.

11. The device in claim 9 wherein said breechblock has a frontal cavity therein and said means for moving said breechblock is attached in said frontal cavity.

12. The device claimed in claim 10 wherein there is a first cavity in said breechblock having a hammer movably mounted therein, means operable by the movement of said action lever to move said hammer from a forward firing position to a rearward cocked position, spring means for said hammer, tigger means for releasing said hammer, a firing pin mounted on said breechblock and being engaged by said hammer to move forwardly through an opening in said breechblock to fire said cartridge.

13. The device in claim 9 wherein: said receiver has grooves therein and said breechblock has projections which fit into and slide in said grooves, a portion of said breechblock being moved against said extractor to pivot same to remove said cartridge.

* * * * *